US010427827B2

(12) United States Patent
Bitowft

(10) Patent No.: US 10,427,827 B2
(45) Date of Patent: Oct. 1, 2019

(54) BOX WITH IMPROVED GRIPPING FUNCTIONALITY

(71) Applicant: S. C. JOHNSON & SON, INC., Racine, WI (US)

(72) Inventor: Bruce Bitowft, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 94 days.

(21) Appl. No.: 15/883,920

(22) Filed: Jan. 30, 2018

(65) Prior Publication Data

US 2019/0233160 A1 Aug. 1, 2019

(51) Int. Cl.

| | |
|---|---|
| ***B65D 5/42*** | (2006.01) |
| ***B65D 5/00*** | (2006.01) |
| ***B65D 5/46*** | (2006.01) |
| ***B65D 5/02*** | (2006.01) |

(52) U.S. Cl.

CPC ..... *B65D 5/46072* (2013.01); *B65D 5/0227* (2013.01); *B65D 5/4204* (2013.01); *B65D 5/4208* (2013.01); *B65D 5/46088* (2013.01)

(58) Field of Classification Search

CPC ..... B65D 5/46072; B65D 5/4608; B65D 5/46088; B65D 5/0227; B65D 5/0236; B65D 5/4204; B65D 5/4208

USPC ..... 229/117.13, 162.3, 117.14, 117.15, 120, 229/162.1

See application file for complete search history.

(56) References Cited

U.S. PATENT DOCUMENTS

| | | | | |
|---|---|---|---|---|
| 2,316,701 | A | 4/1943 | Marshall | |
| 2,653,742 | A | 9/1953 | Currie | |
| 4,314,639 | A * | 2/1982 | Gloyer | B65D 5/46088 206/141 |
| 4,817,866 | A * | 4/1989 | Wonnacott | B65D 5/441 206/141 |
| 4,946,093 | A * | 8/1990 | Moorman | B65D 5/4295 229/120 |
| 5,028,000 | A * | 7/1991 | Chabot | B65D 5/0045 229/143 |
| 5,065,937 | A | 11/1991 | Ritter | |
| 5,181,651 | A * | 1/1993 | Oppenheim | B65D 5/0254 229/120 |
| 5,462,169 | A | 10/1995 | Dygert et al. | |
| 5,497,899 | A | 3/1996 | Wuerfel | |

(Continued)

FOREIGN PATENT DOCUMENTS

| | | | |
|---|---|---|---|
| WO | 9722528 | A1 | 6/1997 |
| WO | 201627655 | A1 | 2/2016 |

*Primary Examiner* — Justin M Larson

(57) ABSTRACT

A box includes at least four side panels. A first minor panel includes a first minor flap. A first major panel includes a first major flap. A second minor panel includes a second minor flap. A second major panel includes a second major flap. The box also includes a top end and a bottom end. The top end includes the first and second minor flaps and the first and second major flaps. The first minor flap is positioned opposite the second minor flap, and the first major flap is positioned opposite the second major flap. Portions of the first and second major flaps overlie portions of the first and second minor flaps. An opening extends through portions of the first and second major flaps between the first and second minor flaps. The opening extends the entire distance between opposing peripheral edges of the first and second major panels.

20 Claims, 9 Drawing Sheets

(56) References Cited

U.S. PATENT DOCUMENTS

| | | | | |
|---|---|---|---|---|
| 5,779,049 | A * | 7/1998 | Werby | B65D 5/326 206/449 |
| 6,302,320 | B1 * | 10/2001 | Stout | B65D 5/46192 229/117.13 |
| 7,681,783 | B2 | 3/2010 | Stephenson | |
| 7,806,313 | B2 * | 10/2010 | Philips | B65D 5/28 229/109 |
| 8,985,431 | B2 * | 3/2015 | Smith | B65D 5/42 229/109 |
| 9,180,996 | B2 | 11/2015 | Mathieu et al. | |
| 9,187,204 | B2 | 11/2015 | Mathieu et al. | |
| 9,415,893 | B2 | 8/2016 | Wintermute et al. | |
| 10,329,048 | B2 * | 6/2019 | Nelson | B65D 5/443 |
| 2006/0006096 | A1 * | 1/2006 | Funk | B65D 5/0227 206/746 |
| 2006/0049067 | A1 | 3/2006 | McDonald | |
| 2008/0237320 | A1 * | 10/2008 | Philips | B65D 5/28 229/109 |
| 2011/0180537 | A1 | 7/2011 | Zimmermann | |
| 2015/0115024 | A1 * | 4/2015 | Finol | B65D 85/34 229/117.16 |
| 2018/0282016 | A1 * | 10/2018 | Prakken | B65D 5/0227 |
| 2018/0370676 | A1 * | 12/2018 | Thompson | B65D 5/40 |

* cited by examiner

BOX WITH IMPROVED GRIPPING FUNCTIONALITY

CROSS REFERENCE TO RELATED APPLICATIONS

Not applicable

REFERENCE REGARDING FEDERALLY SPONSORED RESEARCH OR DEVELOPMENT

Not applicable

SEQUENCE LISTING

Not applicable

BACKGROUND OF THE INVENTION

1. Field of the Invention

The present disclosure generally relates to a box with improved gripping functionality, and more specifically, to a box that includes an opening in a top end providing improved gripping functionality while reducing accidental damage.

2. Description of the Background of the Invention

Shopping clubs, sometimes referred to as big box stores, sell retail products to consumers at a discount by charging an annual fee and requiring bulk purchases (e.g., a multi-pack box) of retail items that are traditionally available in a single container. Furthermore, it is also increasingly common for such bulk purchase offerings to be available in more conventional retail stores or outlets. When selecting such items, the consumer often is required to pick up a multi-pack box and either carry it by itself or transfer it to some sort of cart. At the same time, such multi-pack boxes do not have dedicated gripping features to assist in carrying out these tasks. Thus, users are likely to grab one of the top flaps of the multi-pack boxes to lift the box, which may result in damage to the top flap that is gripped or may result in the multi-pack box being at least partially opened.

Indeed, such issues of moving a multi-pack box also arise in the stocking of store shelves by employees of such big box or retail stores and the transport of those multi-pack boxes to the stores themselves from a distribution or manufacturing facility. Such problems become exacerbated when the items are also heavy or odd-shaped and do not fill a box completely. The shipping boxes are then susceptible to damage during shipping and/or may be difficult to pick-up and move.

One solution is to provide perforated panels that are removable that allow access to the contents contained within the box without completely opening the shipping box. However, that strategy is only effective when the contents of the box include handles or other gripping portions that facilitate moving or dispensing the materials contained within.

Another solution is to include handles within the box that are accessible through openings in the box. This allows for simplified and flexible packaging of the materials contained within the box. However, the blanks to form the boxes become more complex and the weight of the box increases. The end result is a box that has increased manufacturing and materials costs that also increases the cost of shipping.

A different solution is to apply tape along the opposing distal edges of the major flaps. However, this eliminates an access area for gripping and increases costs due to the added tape.

Still yet another solution is to increase the length of the major flaps so they completely overlap. Again, the disadvantage of this design is that it eliminates an access area for gripping and adds costs due to the extra material to extend the flaps.

Another issue experienced when using multi-pack boxes is the inability to display the contents of the box without completely opening the box. It has been found that consumers who purchase such multi-pack boxes often desire to see within the interior of the box to view, for example, the number of items within the box or the type or features of the items in the box. In such instances, users may peel back or otherwise open or dislodge one or more panels on the box to see within, thereby damaging the box. Many solutions have been provided that require a blank having complex structure and/or perforated flaps or panels to permit the contents to be displayed without fully opening the box. Complex structures increase the manufacturing and materials costs.

Therefore, there is a need for a box that provides improved gripping properties while preventing damage when a consumer, retailer, or manufacturer attempts to pick up or move the box. There is also a need to provide a box that provides improved viewability of the contents within the box that prevents damage to the box by a consumer.

SUMMARY OF THE INVENTION

The present disclosure may overcome one or more of the aforementioned drawbacks by providing a box in which a plurality of major flaps and minor flaps cooperate to form a top end of the box. The box includes cutouts forming an opening in the top end of the box. The opening prevents users from gripping the major flaps between the minor flaps and damaging or inadvertently opening the box. This configuration suggests to a user to grip the minor flaps, which are reinforced by portions of the major flaps.

According to one aspect, a box includes at least four side panels. A first minor panel includes a first minor flap, a first major panel includes a first major flap, a second minor panel includes a second minor flap, and a second major panel includes a second major flap. The box also includes a top end and a bottom end, where the top end includes the first and second minor flaps and the first and second major flaps. The first minor flap is positioned opposite the second minor flap, and the first major flap is positioned opposite the second major flap. Portions of the first and second major flaps overlie portions of the first and second minor flaps. An opening extends through portions of the first and second major flaps between the first and second minor flaps. The opening extends the entire distance between opposing peripheral edges of the first and second major panels.

According to another aspect, a box includes at least four side panels. A first minor panel includes a first minor flap, a first major panel includes a first major flap, a second minor panel includes a second minor flap, and a second major panel includes a second major flap. The box also includes a top end and a bottom end, where the top end includes the first and second minor flaps and the first and second major flaps. The first minor flap is positioned opposite the second minor flap and the first major flap is positioned opposite the second major flap. A first cutout extends through the first major flap between a peripheral edge of the first major panel and a distal edge of the first major flap. A second cutout extends through the second major flap between a peripheral edge of the second major panel and a distal edge of the second major flap.

According to a further aspect, a blank includes a first minor panel, a first major panel, a second minor panel, and a second major panel. The first minor panel includes a first minor upper flap. The first major panel includes a first major upper flap having a first cutout that extends from a distal edge of the first major upper flap to a peripheral edge of the first major panel. The second minor panel includes a second minor upper flap. The second major panel includes a second major upper flap having a second cutout that extends from a distal edge of the second major upper flap to a peripheral edge of the second major panel.

BRIEF DESCRIPTION OF THE DRAWINGS

Other aspects and advantages of the present invention will become apparent upon consideration of the following detailed description, wherein similar structures have similar reference numerals.

DETAILED DESCRIPTION

Reference is made in the following disclosure to "major" and "minor" components, i.e., major and minor panels, upper flaps, and lower flaps. In one aspect, as shown in the figures, the "major" components are relatively wider than the counterpart "minor" components. For example, although the major and minor panels in FIG. 1 have the same height, the major panels are wider than the minor panels.

In still another aspect, the "minor" upper flaps may be defined as the flaps disposed closer to an interior volume of the assembled box, i.e., the flaps to whose exterior surfaces glue is applied. The "major" upper flaps then may be defined as the flaps disposed external to those flaps, i.e., the flaps to whose interior surfaces the glue is then adhered. The major and minor panels then may be defined as the panels having an edge in common with the major and minor flaps, respectively. Similarly, the major and minor lower flaps then may be defined as the flaps having an opposite edge in common with the major and minor panels, respectively.

Figure 1:
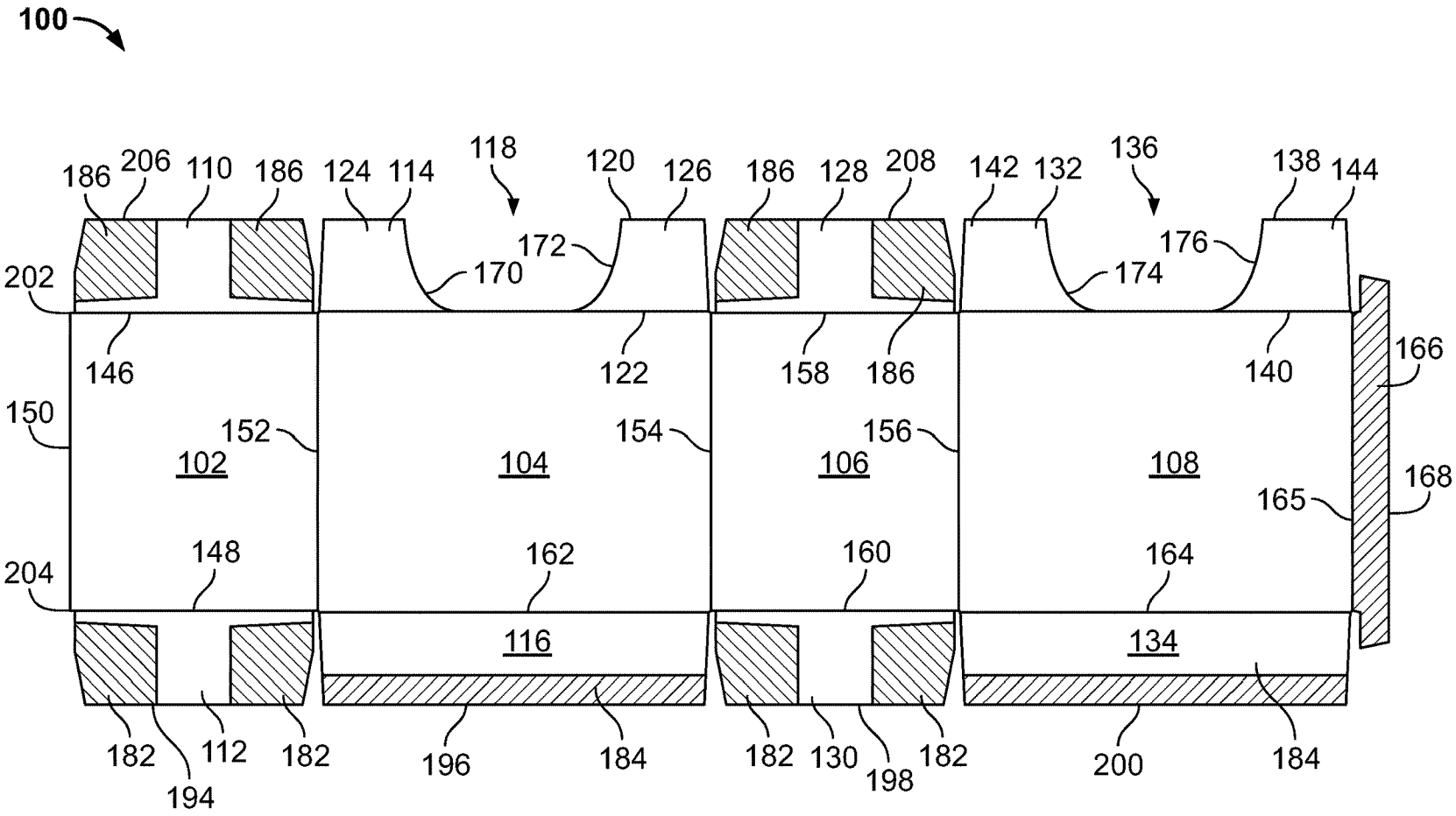
FIG. 1 is a plan view of a first embodiment of a blank of foldable material configured to form a box.

Referring to FIG. 1, a blank 100 is depicted. The blank 100 includes a first minor panel 102, a first major panel 104, a second minor panel 106, and a second major panel 108. The first minor panel 102 includes a first minor upper flap 110 and a first minor lower flap 112. The first major panel 104 includes a first major upper flap 114 and a first major lower flap 116. The first major upper flap 114 defines a first cutout 118 that extends from a distal edge 120 to an upper peripheral edge 122 of the first major panel 104. The first cutout 118 divides the first major flap 114 into a first portion 124 and a second portion 126. The second minor panel 106 includes a second minor upper flap 128 and a second minor lower flap 130. The second major panel 108 includes a second major upper flap 132 and a second major lower flap 134. The second major upper flap 132 defines a second cutout 136 that extends from a distal edge 138 to an upper peripheral edge 140 of the second major panel 108. The second cutout 136 divides the second major flap 132 into a first portion 142 and a second portion 144.

Still referring to FIG. 1, the first minor panel 102 includes an upper peripheral edge 146 and a lower peripheral edge 148 that are fold or score lines for the first minor upper flap 110 and first lower miner flap 112, respectively. A first cut edge 150 of the blank 100 defines one side of the first minor panel 102. A first vertical fold or score line 152 separates the first minor panel 102 from the first major panel 104. A second vertical fold or score line 154 separates the first major panel 104 and the second minor panel 106. A third vertical fold or score line 156 separates the second minor panel 106 and the second major panel 108. The second minor panel 106 also includes an upper peripheral edge 158 and a lower peripheral edge 160 that are fold lines for the second upper minor flap 128 and second lower minor flap 130, respectively. The first major panel 104 includes a lower peripheral edge 162 that is a fold or score line for the first major lower flap 116. The second major panel 108 includes a lower peripheral edge 164 that is a fold or score line for the second major lower flap 134. A fourth vertical fold or score line 165 separates the second major panel 108 from a vertical connector flap 166 that also defines a second cut edge 168.

In the embodiment depicted in FIG. 1, the first portions 124, 142 and second portions 126, 144 of first major upper flap 114 and second major upper flap 132 include curved sides 170, 172, 174, 176, respectively, that define edges of the cutouts 118 and 136. As seen in FIG. 1, the curved sides 170, 172, 174, 176 are concave. It is contemplated and will be shown and discussed in later embodiments that the shape of the curved sides 170, 172, 174, 176 may be different curves or straight lines that change the shape of the cutouts 118, 136.

Figure 2:
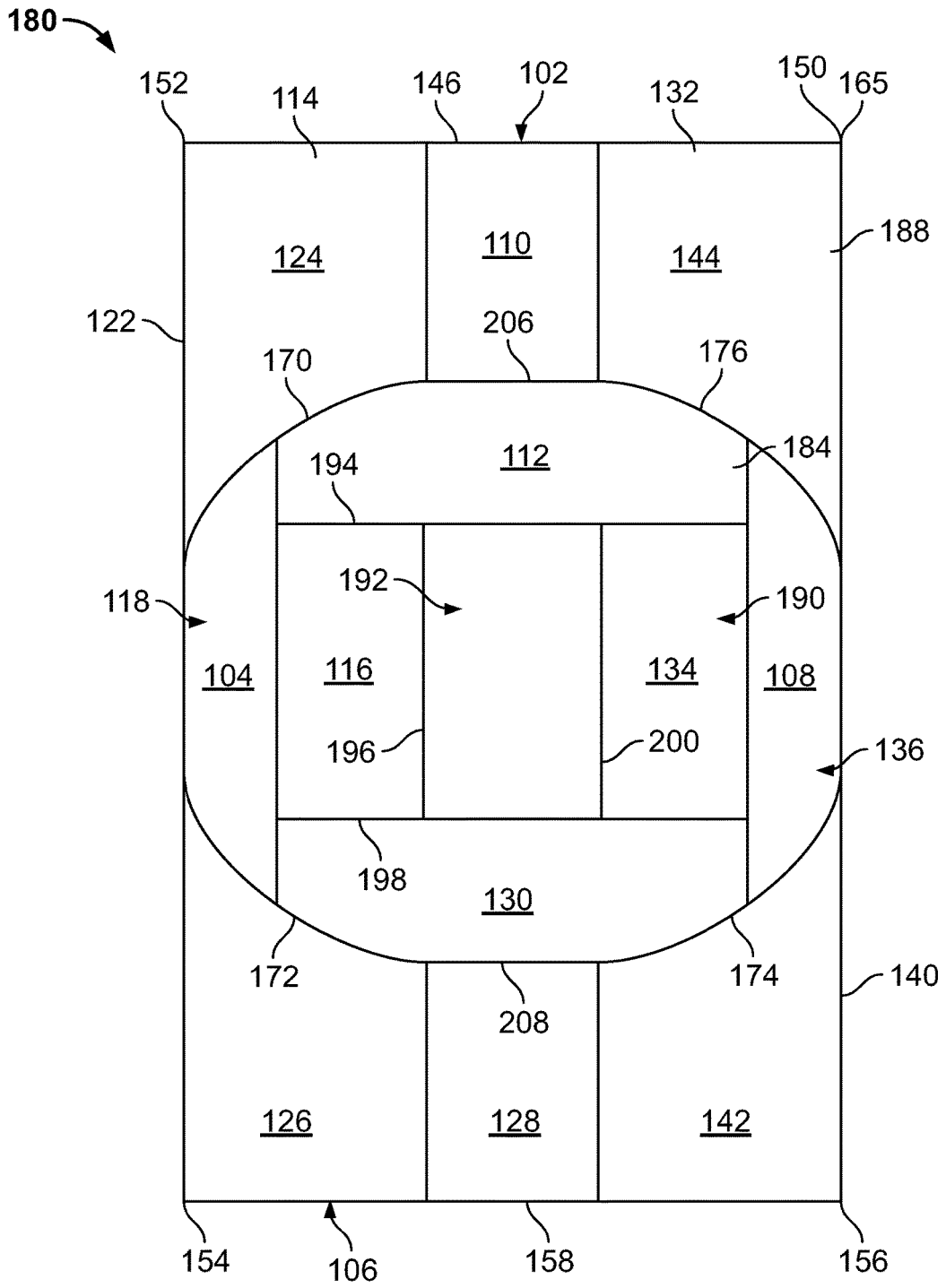
FIG. 2 is a top perspective view of the first embodiment of the box formed from the blank of FIG. 1.

Turning now to FIG. 2, a top view of a box 180 formed from the blank 100 is depicted. As seen with reference to FIGS. 1 and 2, the first step in forming the box 180 is applying glue to the vertical connector flap 166 and folding the blank 100 along the first, second, third, and fourth vertical fold or score lines 152, 154, 156, 165 so that the glued surface of the vertical connector flap 166 is attached to an interior surface (not shown) of the first minor panel 102 to form a rectangular structure. As such, the first minor upper flap 110 is positioned opposite the second minor flap 128, and the first major flap 114 is positioned opposite the second major flap 132. The second step in forming the box 180 is applying glue to the glue regions 182 (see FIG. 1) of the first and second minor lower flaps 112, 130. The third step in forming the box 180 is folding the first and second minor lower flaps 112, 130 inwardly of the lower peripheral edges 148, 160 of the first and second minor panels 102, 106, respectively. The fourth step in forming the box 180 is folding inwardly the first and second major lower flaps 116, 134 at the lower peripheral edges 162, 164 of the first and second major panels 104, 108, respectively. The glue on the glue regions 182 adheres to corresponding inner surfaces (not shown) of the first and second major lower flaps 116, 134, thereby defining a bottom surface 184 of the box 180. After the fourth step is complete, the box 180 is ready to be filled with product. It is contemplated that the formation of the box 180 may be completely automated and occur around the product that will be shipped in the box 180 such that the box 180 is filled as it is formed. Alternatively, the product may be placed in the box 180 after the fourth step is complete. Regardless of filling method, the fifth step is applying glue to glue regions 186 (see FIG. 1) of the first and second minor upper flaps 110, 128. The sixth step in forming the box 180 is folding inwardly the first and second minor upper flaps 110, 128 inwardly of the upper peripheral edges 146, 158 of the first and second minor panels 102, 106, respectively. The seventh and final step to forming box 180 is folding inwardly the first and second major upper flaps 114, 132 so that the glue in the glue regions 186 adheres to inner surfaces (not shown) of the first and second major upper flaps 114, 132. This final step effectively closes the box 180 and forms a top surface 188 that includes an opening 190 comprising the first and second cutouts 118, 136, as well as a gap between the distal ends 206, 208 of the first and second minor upper flaps 110, 128.

With continued reference to FIG. 2, it is contemplated that the shape and proportions of various parts of the blank 100 may vary depending on the size, weight, and proportions of the products to be stored and shipped within the box 180. Further, as depicted in FIG. 2, the bottom surface 184 may include an opening 192 defined by portions of distal edges 194, 196, 198, 200 (see FIG. 1) of the first minor lower flap 112, the first major lower flap 116, the second minor lower flap 130, and the second major lower flap 134, respectively. Whether or not the box 180 includes an opening 192 in the bottom surface 184 may depend on the size, weight, and proportions of the products to be stored and shipped within the box 180. It is further contemplated that the proportions of the first and second minor lower flaps 112, 130 and first and second major lower flaps 116, 134 may be changed to increase the size of the opening 192 or completely eliminate the opening 192 and provide two full layers of foldable materials. It is also contemplated that a top end 202 (see FIG. 1) of the box 180 is defined by the upper peripheral edges 146, 122, 158, 140 of the first minor panel 102, the first major panel 104, the second minor panel 106, and the second major panel 108, respectively. Further, a bottom end 204 (see FIG. 1) of the box 180 is defined by the lower peripheral edges 148, 162, 160, 164 of the first minor panel 102, the first major panel 104, the second minor panel 106, and the second major panel 108, respectively.

Figure 2A:
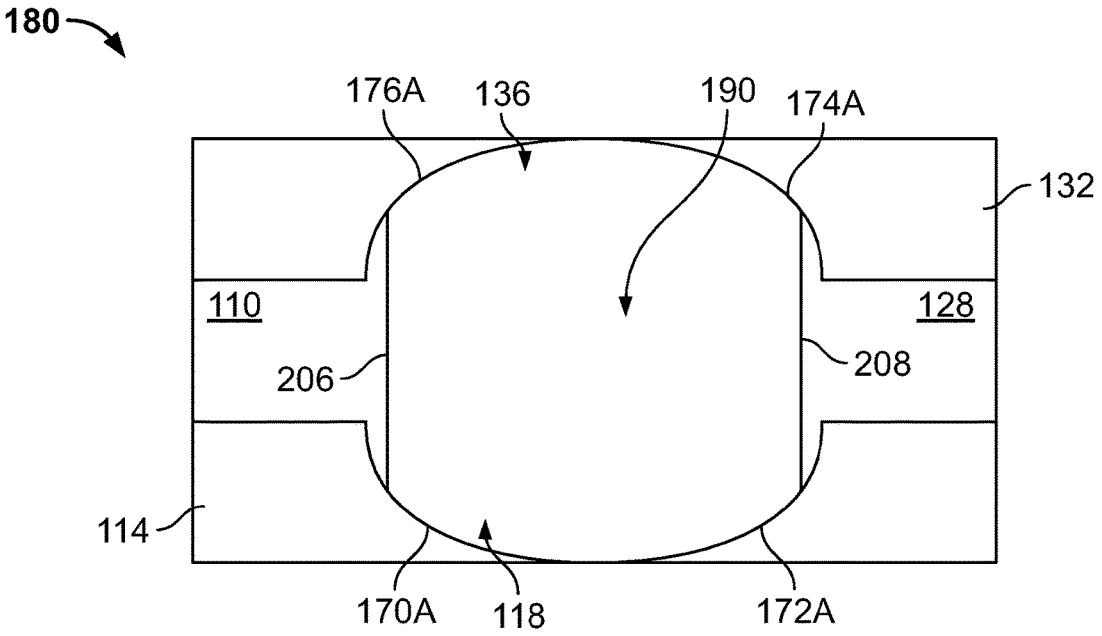
FIG. 2A is a top view of an alternative embodiment of the box of FIG. 2.
Figure 2B:
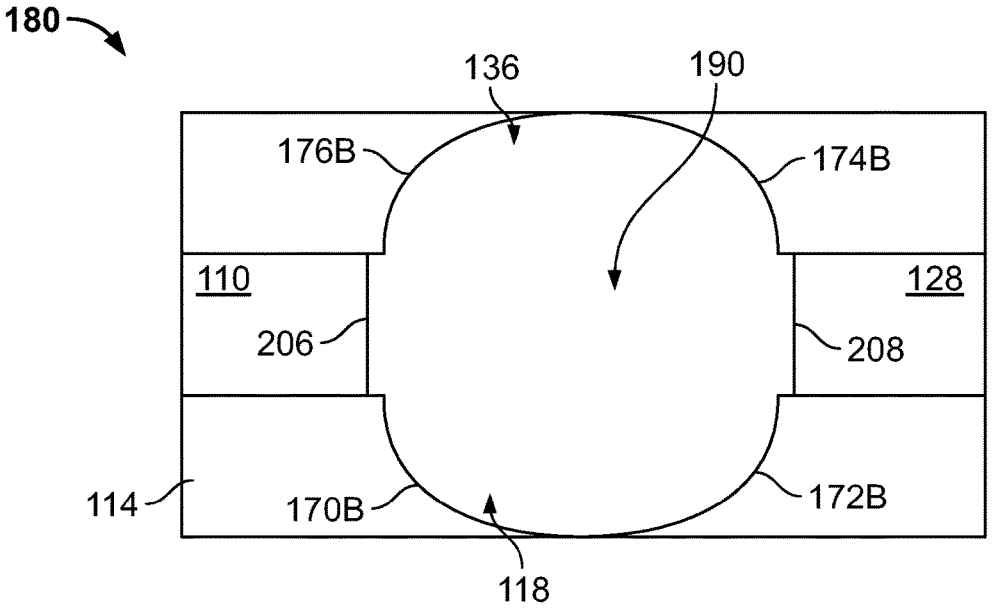
FIG. 2B is a top view of a different embodiment of the box of FIG. 2.
Figure 2C:
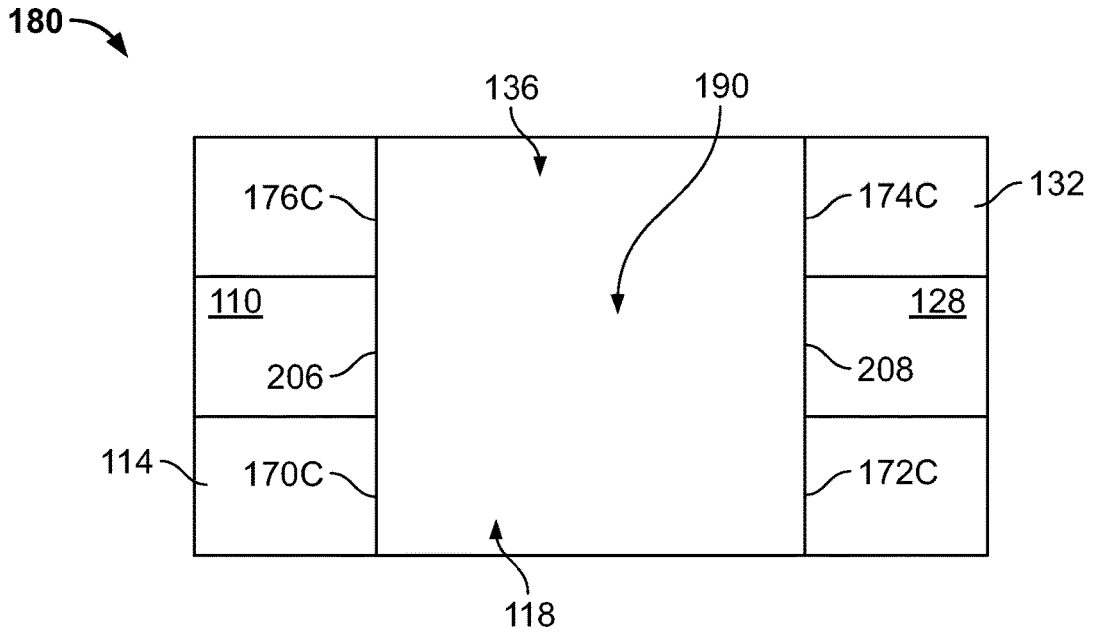
FIG. 2C is a top view of another embodiment of the box of FIG. 2.

As depicted in FIG. 2, the opening 190 in the top surface 188 extends the entire distance between opposing upper peripheral edges 122, 140 of the first and second major panels 104, 106. Surfaces defining the opening 190 also extend past distal ends 206, 208 of the first and second minor upper flaps 110, 128, respectively, with the remaining portions of the opening 190 defined by the distal ends 206, 208. In other configurations, a portion of the edges 170, 172, 174, 176 may overlie portions of the first and second minor upper flaps 110, 128, wherein the opening 190 is then defined by those portions of the peripheral edges 122, 140 aligned with the cutouts 118, 136 and those portions of the edges 170, 172, 174, 176 that do not overlie the minor upper flaps 110, 128 or are coextensive with the distal ends 206, 208 of the minor upper flaps, with any remaining portion of the opening 190 defined by the distal ends 206, 208. For example, FIG. 2A illustrates an embodiment where portions of edges 170A, 172A, 174A, 176A partially extend inwardly from the distal ends 206, 208 and partially extend past the distal ends 206, 208. Alternatively, FIG. 2B depicts an embodiment where portions of edges 170B, 172B, 174B, 176B completely extend past the distal ends 206, 208. It is also contemplated that in some embodiments edges 170C, 172C, 174C, 176C may entirely align with the distal ends 206, 208 (see FIG. 2C).

To demonstrate the improved characteristics of the blank 100 and box 180 over conventional prior art boxes, which utilize opposing major flaps that are uninterrupted and have a gap therebetween, opening force testing was performed on both sets of boxes. A testing machine was first configured to pull vertically on a first major flap and a second major flap of twelve traditional boxes without cutouts. The machine continued to provide a vertical pull until a failure was evidenced, i.e., the flaps were torn from an adjacent flap or otherwise ripped. The results of these tests are shown below in Table 1, which indicates that such conventional boxes failed with an average pull force of 13.7 pound-feet.

TABLE 1

Traditional Boxes without Cutouts

| Box Number | Flap Pulled | Opening Force (lb*f) | Flap Pulled | Opening Force (lb*f) |
|---|---|---|---|---|
| 1 | First | 14.32 | Second | 10.306 |
| 2 | First | 14.09 | Second | 11.266 |
| 3 | First | 17.344 | Second | 15.507 |
| 4 | First | 16.317 | Second | 12.457 |
| 5 | First | 13.04 | Second | 12.726 |
| 6 | First | 17.891 | Second | 12.339 |
| 7 | First | 16.404 | Second | 10.456 |
| 8 | First | 19.213 | Second | 12.22 |
| 9 | First | 15.233 | Second | 9.911 |
| 10 | First | 16.949 | Second | 12.832 |
| 11 | First | 12.032 | Second | 10.162 |
| 12 | First | 13.71 | Second | 12.539 |
| Average | | 15.545 | | 11.893 |
| Standard Deviation | | 2.157 | | 1.583 |
| Max | | 19.213 | | 15.507 |
| Min | | 12.032 | | 9.911 |

The testing machine was then configured to pull vertically on a first minor flap and a second minor flap of twelve boxes formed with cutouts in the major flaps (see FIGS. 1 and 2). The machine continued to provide a vertical pull until a failure was evidenced, i.e., the flaps were torn from an adjacent flap or otherwise ripped. The results of these tests are shown below in Table 2, which indicates that such modified boxes failed with an average pull force of 43.6 pound-feet. The modified boxes with cutouts represent a pull force increase of about two hundred percent over conventional boxes without cutouts. This testing demonstrates that providing cutouts in the major flaps significantly decreases the chance of box failure, by guiding a user to pick up the box under one or more of the minor flaps.

TABLE 2

Improved Boxes with Cutouts

| Box Number | Flap Pulled | Opening Force (lb*f) | Flap Pulled | Opening Force (lb*f) |
|---|---|---|---|---|
| 1 | First | 37.741 | Second | 37.271 |
| 2 | First | 36.735 | Second | 39.199 |

TABLE 2-continued

| Improved Boxes with Cutouts | | | | |
|---|---|---|---|---|
| Box Number | Flap Pulled | Opening Force (lb*f) | Flap Pulled | Opening Force (lb*f) |
| 3 | First | 43.234 | Second | 41.836 |
| 4 | First | 52.969 | Second | 41.307 |
| 5 | First | 44.884 | Second | 44.07 |
| 6 | First | 47.931 | Second | 47.844 |
| 7 | First | 40.552 | Second | 39.487 |
| 8 | First | 49.381 | Second | 52.406 |
| 9 | First | 46.657 | Second | 46.853 |
| 10 | First | 46.052 | Second | 52.768 |
| 11 | First | 39.697 | Second | 37.501 |
| 12 | First | 41.506 | Second | 38.242 |
| Average | | 43.945 | | 43.232 |
| Standard Deviation | | 4.918 | | 5.555 |
| Max | | 52.969 | | 52.768 |
| Min | | 36.735 | | 37.271 |

Figure 3:
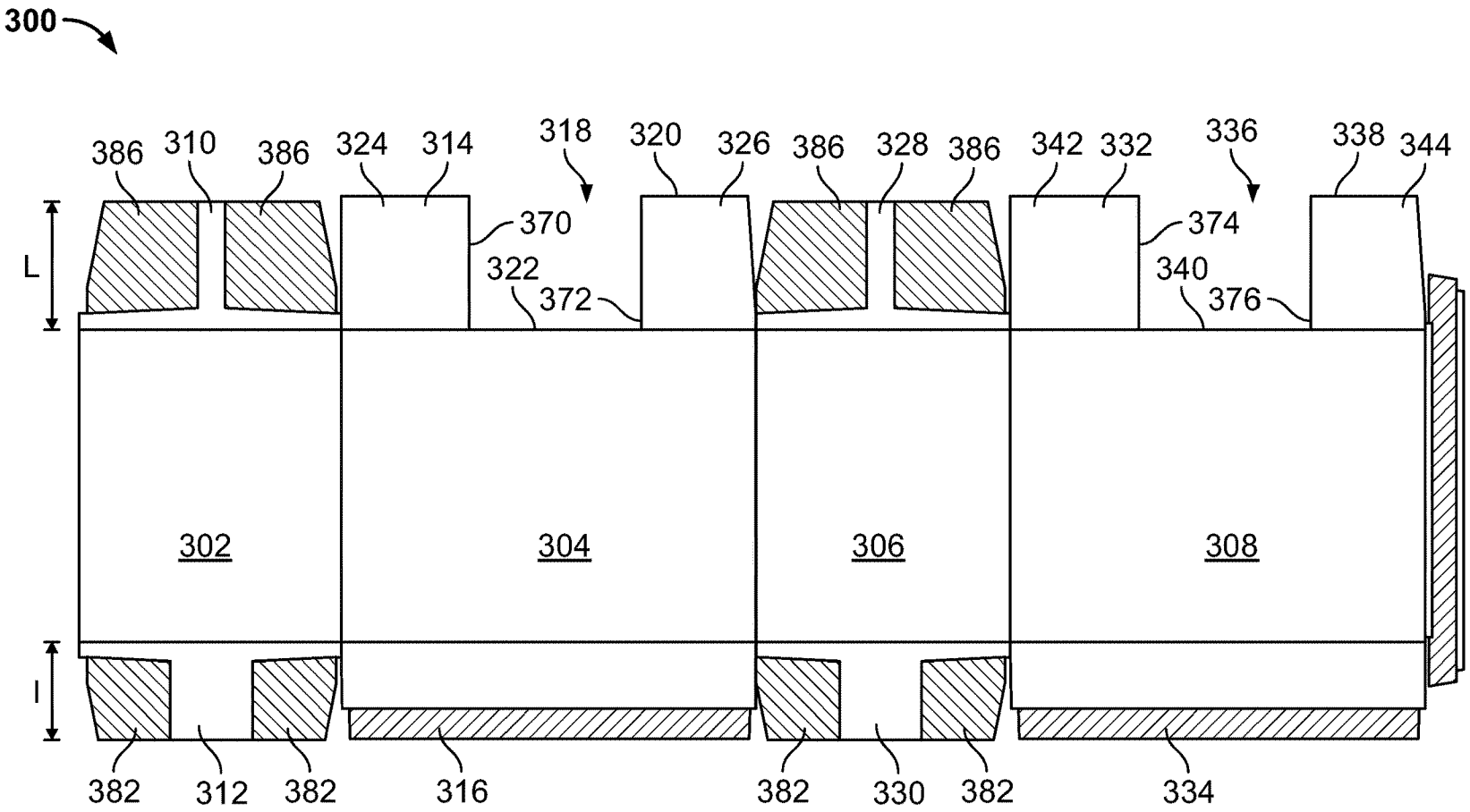
FIG. 3 is a plan view of another embodiment of a blank of foldable material configured to form a box similar to that shown in FIG. 1.

Turning now to FIG. 3, a second embodiment of a blank 300 is depicted. The blank 300 is substantially similar to the blank 100 except that the proportions and shapes of the upper flaps and the lower flaps are different. The blank 300 includes a first minor panel 302, a first major panel 304, a second minor panel 306, and a second major panel 308. The first minor panel 302 includes a first upper minor flap 310 and a first minor lower flap 312. The first major panel 304 includes a first major upper flap 314 and a first major lower flap 316. The first major upper flap 314 defines a first cutout 318 that extends from a distal edge 320 to an upper peripheral edge 322 of the first major panel 304. The first cutout 318 divides the first major flap 314 into a first portion 324 and a second portion 326. The second minor panel 306 includes a second upper minor flap 328 and a second lower minor flap 330. The second major panel 308 includes a second major upper flap 332 and a second major lower flap 334. The second major upper flap 332 defines a second cutout 336 that extends from a distal edge 338 to an upper peripheral edge 340 of the second major panel 308. The second cutout 336 divides the second major flap 332 into a first portion 342 and a second portion 344.

Still referring to FIG. 3, a vertical length "L" of the first and second minor upper flaps 310, 328 and the first and second major upper flaps 314, 332 is larger than the vertical length "l" of the first and second minor lower flaps 312, 330 and the first and second major lower flaps 316, 334. This difference makes glue regions 382 of the first and second minor lower flaps 312, 330 smaller in area when compared to glue regions 386 of the first and second minor upper flaps 310, 328. The larger glue regions 386 permit a larger amount of glue to be used adhering the first and second major upper flaps 314, 332 to the first and second minor upper flaps 310, 332 as compared to the adhesion between the first and second major lower flaps 316, 334 and the first and second minor lower flaps 312, 330, thereby forming a stronger bond between the first and second major upper flaps 314, 332 and the first and second minor upper flaps 310, 328.

Further, straight cut sides 370, 372, 374, 376 of the cutouts 318, 336 may be beneficial for grasping. When a user grasps the combination of the first minor upper flap 310, the first portion 324 of the first major upper flap 314, and/or the second portion 344 of the second major upper flap 332, the larger combined glue regions 386 and the alignment of the sides 370, 376 with the first minor upper flap 310 form a strong structure for lifting. That alignment may prevent a user from grasping any portion of the first portion 324 of the first major upper flap 314 or the second portion 344 of the second major upper flap 332 without also grasping the first minor upper flap 310. Likewise, the combination of the second minor upper flap 328, the second portion 326 of the first major upper flap 314, and/or the first portion 342 of the second major upper flap 332 performs in the same fashion. These combinations may also prevent unintended opening of the box or partial damage to the top of the box from separation of either of the first and/or second major upper flaps 314, 332 from the first and/or second minor upper flaps 310, 328. It is contemplated that the dimensions of the first and second major and minor upper flaps 310, 314, 328, 332 may be modified to accommodate the weight of the products to be held within the box.

FIGS. 4-10 depict top views of boxes formed from alternative embodiments of blanks that are essentially the same as the blanks depicted in FIGS. 1 and 3 except for the pertinent features and elements discussed below. The interiors of the boxes depicted in these figures are not shown, and the openings are depicted as shaded regions for clarity.

Figure 4:
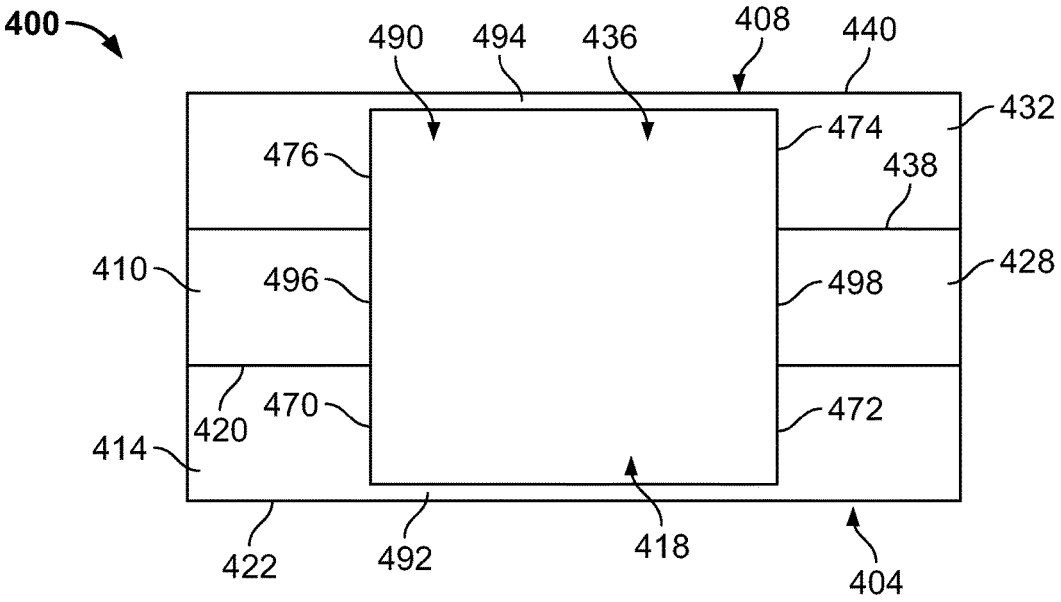
FIG. 4 is a top view of a second embodiment of a box.

Turning to FIG. 4, a top view of a box 400 is depicted. Similar to the blanks and boxes disclosed above, the box 400 includes a first minor upper flap 410 and a second minor upper flap 428. The box 400 also includes a first major upper flap 414 and a second major upper flap 432, both of which overlie portions of both the first and second minor upper flaps 410, 428. The first major upper flap 414 defines a first cutout 418 that extends from a distal end 420 of the first major upper flap 414 to adjacent an upper peripheral edge 422 of a first major panel 404. The first cutout 418 does not extend all the way to the upper peripheral edge 422 in order to leave a first thin strip 492 of foldable material along or adjacent the upper peripheral edge 422. The second major upper flap 432 defines a second cutout 436 that extends from a distal end 438 of the second major upper flap 432 to adjacent an upper peripheral edge 440 of a second major panel 408. The second cutout 436 does not extend all the way to the upper peripheral edge 440 in order to leave a second thin strip 494 of foldable material along or adjacent the upper peripheral edge 440. The first cutout 418 and the second cutout 436 combine along with distal ends 496, 498 of the first and second minor upper flaps 410, 428 to define an opening 490 in a top surface of the box 400.

It is contemplated that the size and shape of the first and second cutouts 418, 436 along with the first and second minor upper flaps 410, 428 may be adjusted depending on the size, weight, and/or shape of the products to be stored and shipped in the box 400. Further, the first and second thin strips 492, 494 may provide extra retention characteristics for holding the contents of the box 400. In one aspect, the length of the first and second thin strips 492, 494 each may be between about 3% and about 30% of a vertical length of the major upper flaps, or between about 3% and about 15% of that vertical length, or between about 3% and about 7.5% of that vertical length. In another aspect, the length of the first and second thin strips 492, 494 may be in the range from about 2.54 millimeters to about 25.4 millimeters, or from about 2.54 millimeters to about 12.7 millimeters, or from about 2.54 millimeters to about 6.35 millimeters.

In the embodiment depicted in FIG. 4, straight cut edges 470, 472 of the first cutout 418 and straight cut edges 474, 476 of the second cutout 436 align with the distal ends 496, 498 of the first and second minor upper flaps 410, 428. As such, the opening 490 is defined by interior surfaces of the first and second strips 492, 494 facing the first and second cutouts 418, 436, as well as the distal ends 496, 498 of the first and second minor flaps 410, 428 and the aligned edges 470, 472, 474, 476. It is also contemplated that the opening 490 may be similarly modified as disclosed in connection with the other embodiments disclosed herein (e.g., FIGS. 2-2C).

Figure 5:
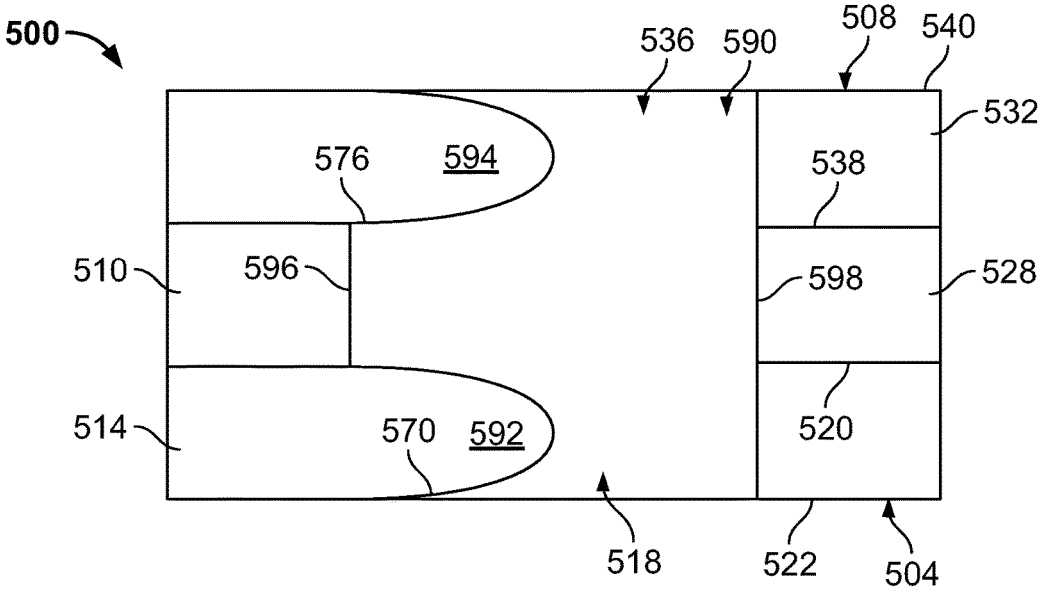
FIG. 5 is a top view of a third embodiment of a box.

Turning now to FIG. 5, a top view of a box 500 is depicted. Similar to the blanks and boxes disclosed above, the box 500 includes a first minor upper flap 510 and a second minor upper flap 528. The box 500 also includes a first major upper flap 514 and a second major upper flap 532, both of which overlie portions of both the first and second minor upper flaps 510, 528. The first major upper flap 514 defines a first cutout 518 that extends from a distal end 520 of the first major upper flap 514 to an upper peripheral edge 522 of a first major panel 504. The second major upper flap 532 defines a second cutout 536 that extends from a distal end 538 of the second major upper flap 532 to an upper peripheral edge 540 of a second major panel 508. Surfaces defining the first cutout 518 and the second cutout 536 in combination with the distal ends 596, 598 of the first and second minor upper flaps 510, 528 define an opening 590 in a top surface of the box 500. An edge 570 defining a portion of the first cutout 518 forms a first protrusion 592. An edge 576 defining a portion of the second cutout 536 forms a second protrusion 594.

The first and second protrusions 592, 594 may provide extra protection for the contents or specific portions of the contents of the box 500. For example, containers positioned within the box 500 may include a window to display the product therein. The window may be more susceptible to damage than the container materials. Thus, the first and second protrusions 592, 594 may be sized and shaped to cover the window of the containers contained within the box 500. Additionally, or alternatively, the first and second protrusions 592, 594 may be provided to assist in retaining items within the box 500 while still providing visibility of those contents and improved gripability of the box. For example, if multiple items were retained in the box 500, one of those items could be held under a portion of the first upper minor flap 510 and the second protrusion 594, a second item could be provided adjacent to the first item and held under the second protrusion 594 and the second cutout 536, and a third item could be provided adjacent the second item and held beneath the second cutout 536 and the second minor flap 528. The first minor flap 510, the first protrusion 591, the first cutout 518, and the second minor flap 528 may similarly act on the first, second, and third items or act in a similar manner on fourth, fifth, and sixth items. It is contemplated that the protrusions 592, 594 may be any size, shape, and/or orientation that is favorable and/or convenient. It is also contemplated that any number of protrusions may extend from any number of portions of the box 500 that at least partially define a portion of the perimeter of the opening 590.

Figure 6:
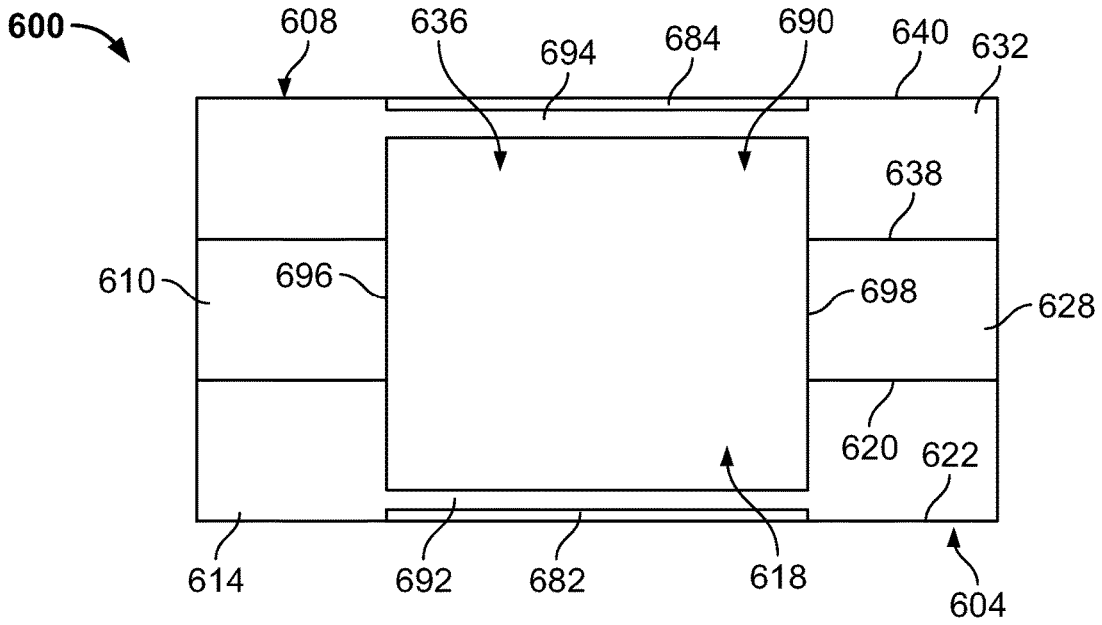
FIG. 6 is a top view of a fourth embodiment of a box.

Turning now to FIG. 6, a top view of a box 600 is depicted. Similar to the blanks and boxes disclosed above, the box 600 includes a first minor upper flap 610 and a second minor upper flap 628. The box 600 also includes a first major upper flap 614 and a second major upper flap 632, both of which overlie portions of both the first and second minor upper flaps 610, 628. The first major upper flap 614 defines a first cutout 618 that extends from a distal end 620 of the first major upper flap 614 to adjacent an upper peripheral edge 622 of a first major panel 604. The first cutout 618 does not extend all the way to the upper peripheral edge 622 in order to leave a first thin strip 692 of material adjacent the upper peripheral edge 622. The second major upper flap 632 defines a second cutout 636 that extends from a distal end 638 of the second major upper flap 632 to adjacent an upper peripheral edge 640 of a second major panel 608. The second cutout 636 does not extend all the way to the upper peripheral edge 640 in order to leave a second thin strip 694 of material adjacent the upper peripheral edge 640. Surfaces defining the first cutout 618 and the second cutout 636 in combination with the distal ends 696, 698 of the first and second minor upper flaps 610, 628 define an opening 690 in a top surface of the box 600.

It is contemplated that the first and second thin strips 692, 694 may provide extra retention characteristics for holding the contents of the box 600. In one aspect, the length of the first and second thin strips 692, 694 each may be between about 3% and about 30% of a vertical length of the major upper flaps, or between about 3% and about 15% of that vertical length, or between about 3% and about 7.5% of that vertical length. In another aspect, the length of the first and second thin strips 692, 694 may be in the range from about 2.54 millimeters to about 25.4 millimeters, or from about 2.54 millimeters to about 12.7 millimeters, or from about 2.54 millimeters to about 6.35 millimeters.

It is contemplated that during assembly of the box 600, folding the first and second thin strips 692, 694 may be difficult or problematic as the thickness of the foldable material increases. To alleviate this potential issue, while still providing increased retention of the contents, the box 600 may include cut or score lines 682, 684 that are positioned adjacent the first and second thin strips 692, 694 at the upper peripheral edges 622, 640 of the first and second major panels 604, 608, respectively. It is also contemplated that the lines 682, 684 may comprise a single long cut that extends the width of the first and second cutouts 618, 636, or a single long score line that extends the width of the first and second cutouts 618, 636, or a combination of cut and score lines that extend the width of the first and second cutouts 618, 636. In connection with the embodiment having a combination of cut and score lines, the ratio of the lengths of the cut and score lines may be varied depending on the thickness of the foldable material and the size of the first and second thin strips 692, 694.

Figure 7:
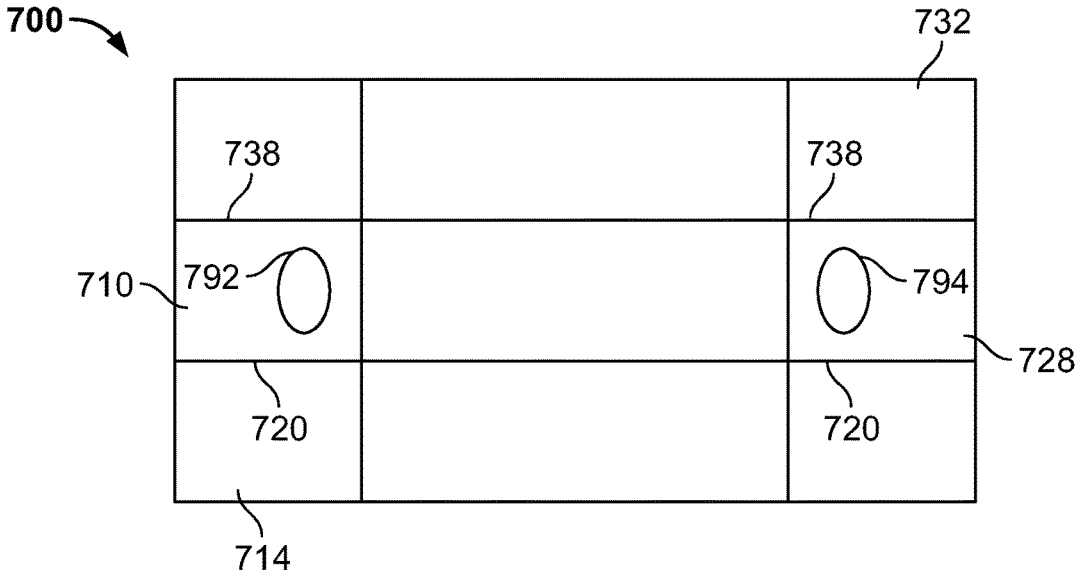
FIG. 7 is a top view of a fifth embodiment of a box.

Turning now to FIG. 7, a top view of a box 700 is depicted. The box is substantially similar to the boxes and blanks disclosed earlier. However, a first minor upper flap 710 defines a first secondary cutout 792 and a second minor upper flap 728 defines a second secondary cutout 794. The first and second secondary cutouts 792, 794 are positioned between distal ends 720, 738 of first and second major upper flaps 714, 732, respectively. In the embodiment depicted in FIG. 7, the first and second secondary cutouts 792, 794 are shown as oval-shaped openings. It is contemplated that the first and second secondary cutouts 792, 794 may be used as a grip hole for a user to pick up the box 700. It is also contemplated that the first and second secondary cutouts 792, 794 may be any shape, size, and/or orientation.

Figure 8:
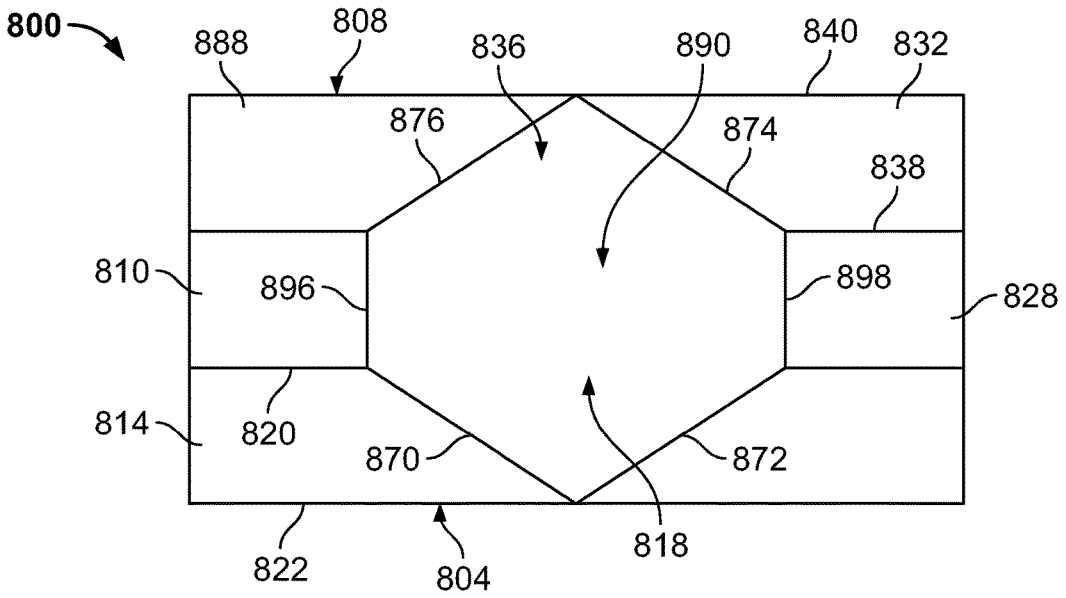
FIG. 8 is a top view of a sixth embodiment of a box.

Turning now to the embodiment depicted in FIG. 8, a top view of a box 800 is depicted. Similar to the blanks and boxes disclosed above, the box 800 includes a first minor upper flap 810 and a second minor upper flap 828. The box 800 also includes a first major upper flap 814 and a second major upper flap 832, both of which overlie portions of both the first and second minor upper flaps 810, 828. The first major upper flap 814 defines a first cutout 818 that extends from a distal end 820 of the first major upper flap 814 to an upper peripheral edge 822 of a first major panel 804. The second major upper flap 832 defines a second cutout 836 that extends from a distal end 838 of the second major upper flap 832 to an upper peripheral edge 840 of a second major panel 808. Surfaces defining the first cutout 818 and the second cutout 836 in combination with distal ends 896, 898 of the first and second minor upper flaps 810, 828, respectively, define an opening 890 in a top surface 888 of the box 800.

In the embodiment depicted in FIG. 8, edges 870, 872 of the first cutout 818 and edges 874, 876 of the second cutout 836 extend away from the distal ends 896, 898 of the first and second minor upper flaps 810, 828. The reduction of the opening 890 in this embodiment by extending the edges 870, 872, 874, 876 may provide a combination of improved retention and protection of the contents of the box 800. Further, an improved aesthetic property of the entire box 800 may be provided. It is contemplated that the edges 870, 872, 874, 876 do not have to be straight. Instead, they may incorporate any curve or angle that is desired. It is also contemplated that the design of the edges 870, 872, 874, 876 may discourage a user from gripping any part of the opening except the exposed distal ends 896, 898 of the first and second minor upper flaps 810, 828.

Figure 9:
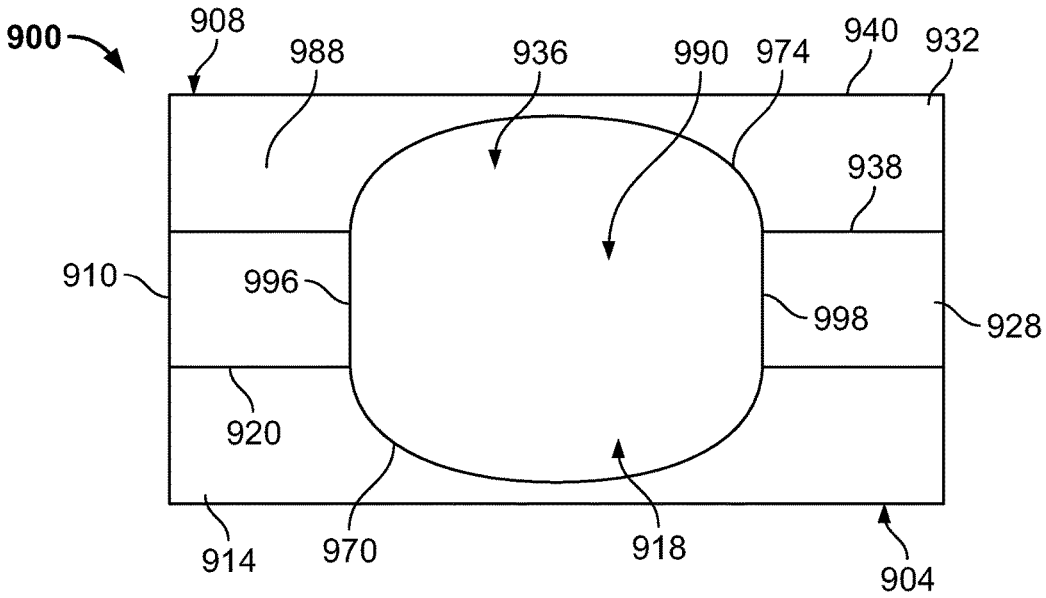
FIG. 9 is a top view of a seventh embodiment of a box.

Turning now to FIG. 9, a top view of a box 900 is depicted. Similar to the blanks and boxes disclosed above, the box 900 includes a first minor upper flap 910 and a second minor upper flap 928. The box 900 also includes a first major upper flap 914 and a second major upper flap 932, both of which overlie portions of both the first and second minor upper flaps 910, 928. The first major upper flap 914 defines a first cutout 918 that extends from a distal end 920 of the first major upper flap 914 to adjacent an upper peripheral edge 922 of a first major panel 904. The second major upper flap 932 defines a second cutout 936 that extends from a distal end 938 of the second major upper flap 932 to adjacent an upper peripheral edge 940 of a second major panel 908. Surfaces defining the first cutout 918 and the second cutout 936 in combination with the distal ends 996, 998 of the first and second minor upper flaps 910, 928 define an opening 990 in a top surface 988 of the box 900.

In the embodiment depicted in FIG. 9, edge 970 of the first cutout 918 and edge 974 of the second cutout 936 form curved, continuous edges that extend from a distal end 996 of the first minor upper flap 910 to a distal end 998 of the second minor upper flap 928. Each section of the edges 970, 974 may include between about 90 degrees and about 150 degrees of arc. It is contemplated that this edge structure may be favorable to provide improved retention and/or protection to the contents of the box 900 while also providing improved aesthetics to the box 900.

Figure 10:
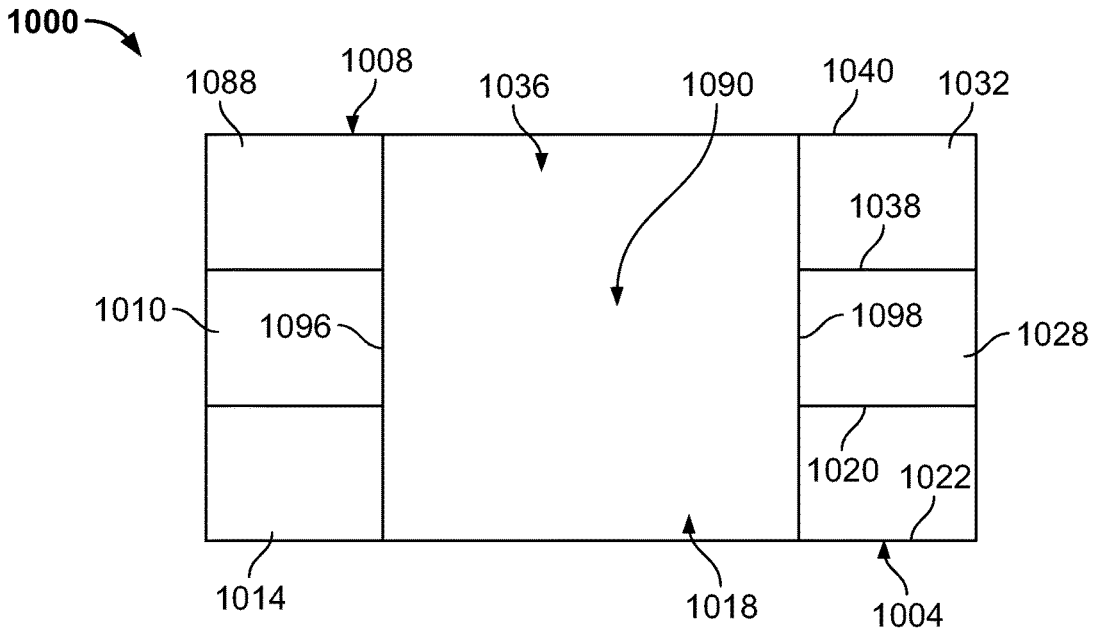
FIG. 10 is a top view of an eighth embodiment of a box.
Figure 11:
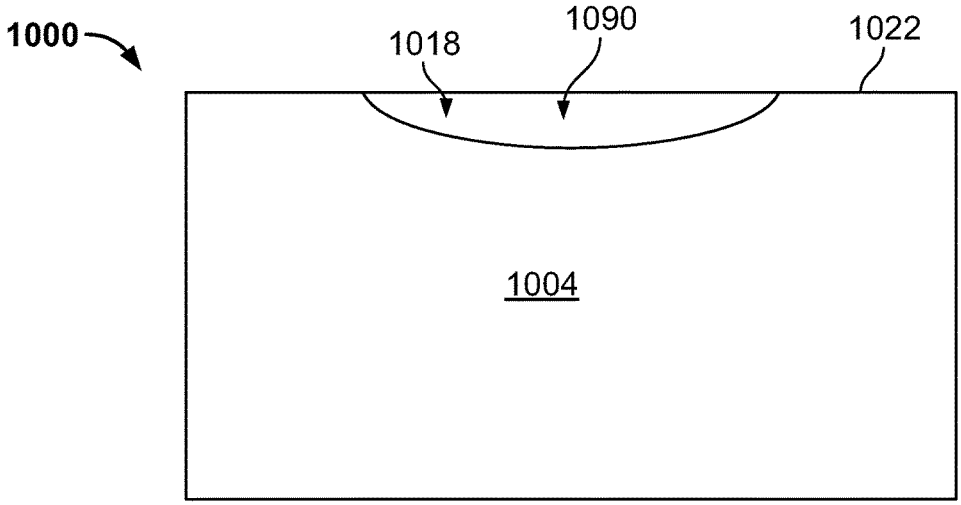
FIG. 11 is a front elevational view of the box of FIG. 10.

Turning now to the embodiment depicted in FIGS. 10 and 11, a top view and a side view of a box 1000 are depicted. Similar to the blanks and boxes disclosed above, the box 1000 includes a first minor upper flap 1010 and a second minor upper flap 1028. The box 1000 also includes a first major upper flap 1014 and a second major upper flap 1032, both of which overlie portions of both the first and second minor upper flaps 1010, 1028. The first major upper flap 1014 defines a first cutout 1018 that extends from a distal end 1020 of the first major upper flap 1014 to past an upper peripheral edge 1022 of a first major panel 1004 and onto the first major panel 1004. The second major upper flap 1032 defines a second cutout 1036 that extends from a distal end 1038 of the second major upper flap 1032 to past an upper peripheral edge 1040 of a second major panel 1008 (not shown). Surfaces defining the first cutout 1018 and the second cutout 1036 in combination with the distal ends 1096, 1098 of the first and second minor upper flaps 1010, 1028, respectively, define an opening 1090 in a top surface 1088 of the box 1000. Extending the first and second cutouts 1018, 1036 onto the first and second major panels 1004, 1008 may reduce the shipping weight of the box 1000 when the contents of the box 1000 require less protection and retention. It is contemplated that the portions of the first and second cutouts 1018, 1036 that extend onto the first and second major panels 1004, 1008 may be any shape and/or size as long as adequate retention and/or protection is provided to the contents of the box 1000.

It is contemplated that the blanks and boxes disclosed herein may be manufactured from foldable materials, e.g., paper, paperboard, cardboard, or corrugated fiberboard. However, one having skill in the art would understand that that the blanks and boxes may be constructed using any number of foldable materials or combination of materials.

It is also contemplated that any of the embodiments disclosed herein could be modified to have minor flaps provided above major flaps, but otherwise be structurally identical to the disclosed embodiments. Furthermore, it is also contemplated that such modified embodiments may be further modified to include cutouts through the minor flaps to peripheral edges of the minor panels.

It is still further contemplated that any of the disclosed embodiments could be implemented on square boxes. In such instances, the major and minor flaps and panels may be broadly characterized as first and second or differing flaps and panels, but otherwise are structurally identical to the disclosed embodiments.

Any of the embodiments described herein may be modified to include any of the structures or methodologies disclosed in connection with different embodiments. Further, the present disclosure is not limited to blanks or boxes of the type specifically shown. Still further, the blanks or boxes of any of the embodiments disclosed herein may be modified to work with any type or shape of blank or box or the like.

INDUSTRIAL APPLICABILITY

A box is presented that provides an improved gripping functionality. Thus, a user may be grasp the box and not damage or inadvertently open the box.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

I claim:

1. A box, comprising:

at least four side panels, including:

a first minor panel foldably coupled to a first minor flap;

a first major panel foldably coupled to a first major flap;

a second minor panel foldably coupled to a second minor flap;

a second major panel foldably coupled to a second major flap;

a top end; and a bottom end, wherein the top end includes the first and second minor flaps and the first and second major flaps, with the first minor flap positioned opposite the second minor flap, and the first major flap positioned opposite the second major flap, wherein portions of the first and second major flaps overlie portions of the first and second minor flaps, wherein an opening extends through portions of the first and second major flaps between the first and second minor flaps, and wherein the opening extends an entire distance between opposing peripheral edges of the first and second major panels.

2. The box of claim 1, wherein a portion of the opening is defined by edges of the first and second minor flaps.

3. The box of claim 2, wherein the opening is defined by the edges of the first and second minor flaps and the opposing peripheral edges of the first and second major panels.

4. The box of claim 2, wherein the opening is partially defined by the edges of the first and second minor flaps and the opposing peripheral edges of the first and second major panels.

5. The box of claim 1, wherein at least one of the first minor flap and the second minor flap includes a grip hole.

6. The box of claim 1, wherein at least one of the first major flap and the second major flap include a protrusion that extends into the opening.

7. A box, comprising:

at least four side panels, including:

a first minor panel foldably coupled to a first minor flap;

a first major panel foldably coupled to a first major flap;

a second minor panel foldably coupled to a second minor flap; and a second major panel foldably coupled to a second major flap;

a top end; and a bottom end, wherein the top end includes the first and second minor flaps and the first and second major flaps, with the first minor flap positioned opposite the second minor flap, and the first major flap positioned opposite the second major flap, wherein a first cutout extends through the first major flap between a peripheral edge of the first major panel and a distal edge of the first major flap, and wherein a second cutout extends through the second major flap between a peripheral edge of the second major panel and a distal edge of the second major flap.

8. The box of claim 7, wherein portions of the first and second major flaps overlie portions of the first and second minor flaps.

9. The box of claim 7, wherein surfaces defining the first cutout that are not coextensive with the peripheral edge of the first major panel at least partially align with a first edge of the first minor flap.

10. The box of claim 9, wherein surfaces defining the first cutout that are not coextensive with the peripheral edge of the first major panel also at least partially align with a second edge of the second minor flap.

11. The box of claim 10, wherein surfaces defining the second cutout that are not coextensive with the peripheral edge of the second major panel at least partially align with the first and second edges of the first and second minor flaps, respectively.

12. The box of claim 7, wherein surfaces defining the first cutout that are not coextensive with the peripheral edge of the first major panel are coextensive with first and second edges of the first and second minor flaps, respectively.

13. The box of claim 12, wherein surfaces defining the second cutout that are not coextensive with the peripheral edge of the second major panel are coextensive with the first and second edges of the first and second minor flaps, respectively.

14. The box of claim 7, wherein surfaces defining the first and second cutouts do not extend inwardly from first and second edges of the first and second minor flaps.

15. The box of claim 7, wherein at least one of the first minor flap and the second minor flap includes a grip hole.

16. A blank, comprising:

a first minor panel foldably coupled to a first minor upper flap;

a first major panel foldably coupled to a first major upper flap having a first cutout that extends from a distal edge of the first major upper flap to a peripheral edge of the first major panel;

a second minor panel foldably coupled to a second minor upper flap; and a second major panel foldably coupled to a second major upper flap having a second cutout that extends from a distal edge of the second major upper flap to a peripheral edge of the second major panel.

17. The blank of claim 16, wherein at least one of the first minor upper flap and the second minor upper flap includes a grip hole.

18. The blank of claim 16, wherein the first cutout extends past the peripheral edge of the first major panel and onto the first major panel.

19. The blank of claim 16, wherein the first major upper flap includes a protrusion that defines a portion of the first cutout.

20. The blank of claim 19, wherein the second major upper flap includes a protrusion that defines a portion of the second cutout.

* * * * *